US011795726B2

(12) United States Patent
Stinson, Sr.

(10) Patent No.: US 11,795,726 B2
(45) Date of Patent: Oct. 24, 2023

(54) FENCE POST SLEEVE ASSEMBLY

(71) Applicant: David B. Stinson, Sr., Bakersfield, CA (US)

(72) Inventor: David B. Stinson, Sr., Bakersfield, CA (US)

( * ) Notice: Subject to any disclaimer, the term of this patent is extended or adjusted under 35 U.S.C. 154(b) by 115 days.

(21) Appl. No.: 17/522,024

(22) Filed: Nov. 9, 2021

(65) Prior Publication Data

US 2023/0147876 A1 May 11, 2023

(51) Int. Cl.
*E04H 12/22* (2006.01)
*E04H 17/22* (2006.01)
*E04H 17/00* (2006.01)

(52) U.S. Cl.
CPC ..... *E04H 12/2269* (2013.01); *E04H 17/009* (2021.01); *E04H 17/22* (2013.01); *E04H 12/2253* (2013.01); *E04H 12/2292* (2013.01)

(58) Field of Classification Search
CPC ... E04H 12/2269; E04H 17/009; E04H 17/22; E04H 12/2292; E04H 12/2253; E02D 27/42
See application file for complete search history.

(56) References Cited

U.S. PATENT DOCUMENTS 4,543,757 A * 10/1985 Cosgrove ..... E02D 27/42 52/165
4,815,713 A 3/1989 Schmanski
6,098,353 A 8/2000 Stanfield
6,389,760 B1 5/2002 McDonnell
D484,252 S 12/2003 Hughes
D610,718 S * 2/2010 Ringus ..... D25/133
7,739,840 B1 * 6/2010 Castellanos ..... E04D 12/008 52/465
8,622,364 B2 * 1/2014 Bergman ..... E04H 12/2269 52/361
10,458,143 B2 10/2019 Knudsen
10,597,893 B2 * 3/2020 Tersigni ..... E04H 12/2292
11,078,677 B2 * 8/2021 Radke ..... E04B 1/98
2004/0134146 A1 7/2004 Brown
2006/0185270 A1 * 8/2006 Handley ..... E04C 3/30 52/169.14
2016/0237712 A1 * 8/2016 Finnegan ..... E04H 12/2215
2019/0284828 A1 * 9/2019 Benton ..... E04H 12/2269

FOREIGN PATENT DOCUMENTS

CA 2670667 12/2009
GB 2290810 A * 1/1996 ..... E01F 13/024

* cited by examiner

*Primary Examiner* — Brian D Mattei
*Assistant Examiner* — Omar F Hijaz

(57) ABSTRACT

A fence post sleeve assembly for facilitating a fence post to easily be removed or replaced includes a post guide which includes a first half that is coupled to a second half. The post guide defines a sleeve to insertably receive a fence post. Furthermore, the post guide is comprised of a rigid material thereby facilitating the post guide to be buried in a post hole without collapsing. In this way the fence post can be inserted or removed from the post hole. A base is attached to the post guide to inhibit the fence post from passing through the sleeve defined by the first half and the second half.

6 Claims, 7 Drawing Sheets

FENCE POST SLEEVE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sleeve devices and more particularly pertains to a new sleeve device for facilitating a fence post to easily be removed or replaced. The device includes a sleeve that is defined by a first half attached to a second half. The sleeve is insertable into a post hole and a fence post is insertable into the sleeve. In this way the fence post can be easily removed or replaced.

(2) Description of Related Art Including Information Disclosed Under 37 CFR 1.97 and 1.98

The prior art relates to sleeve devices including a pair of brackets that are positionable around a fence post. The prior art discloses a rectangular sleeve that is insertable into a post hole for insertably receiving a fence post. The prior art discloses a variety of sleeves that are positionable around a buried portion of a fence post for protecting the fence post against moisture. The prior art discloses a post sleeve which is constructed of reinforced concrete and which includes drainage channels integrated into the post sleeve for draining moisture around a fence post that is inserted into the post sleeve. The prior art discloses a post sleeve which has a corrugated interior surface for engaging a fence post to retain the fence post in the post sleeve.

BRIEF SUMMARY OF THE INVENTION

An embodiment of the disclosure meets the needs presented above by generally comprising a post guide which includes a first half that is coupled to a second half. The post guide defines a sleeve to insertably receive a fence post. Furthermore, the post guide is comprised of a rigid material thereby facilitating the post guide to be buried in a post hole without collapsing. In this way the fence post can be inserted or removed from the post hole. A base is attached to the post guide to inhibit the fence post from passing through the sleeve defined by the first half and the second half.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
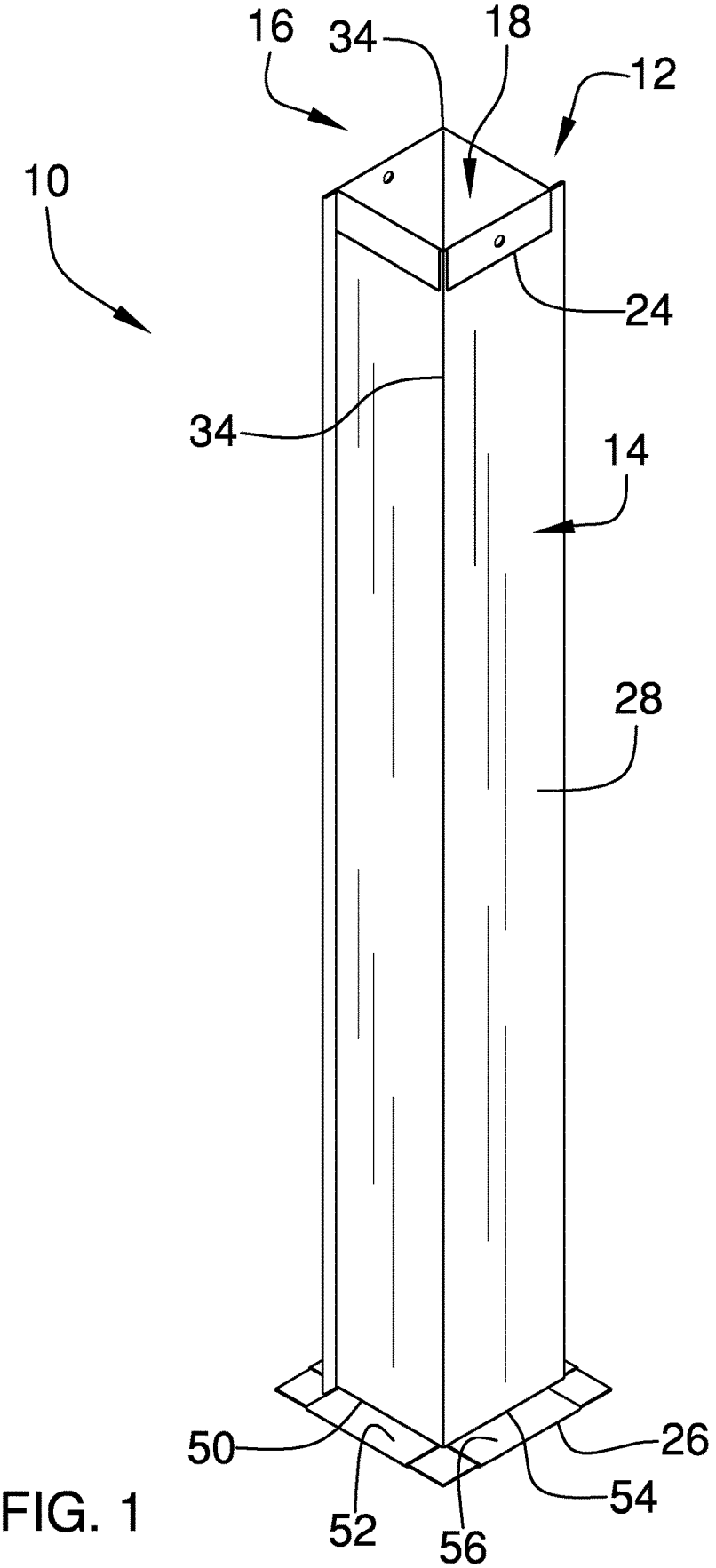
FIG. 1 is a perspective view of a fence post sleeve assembly according to an embodiment of the disclosure.
Figure 2:
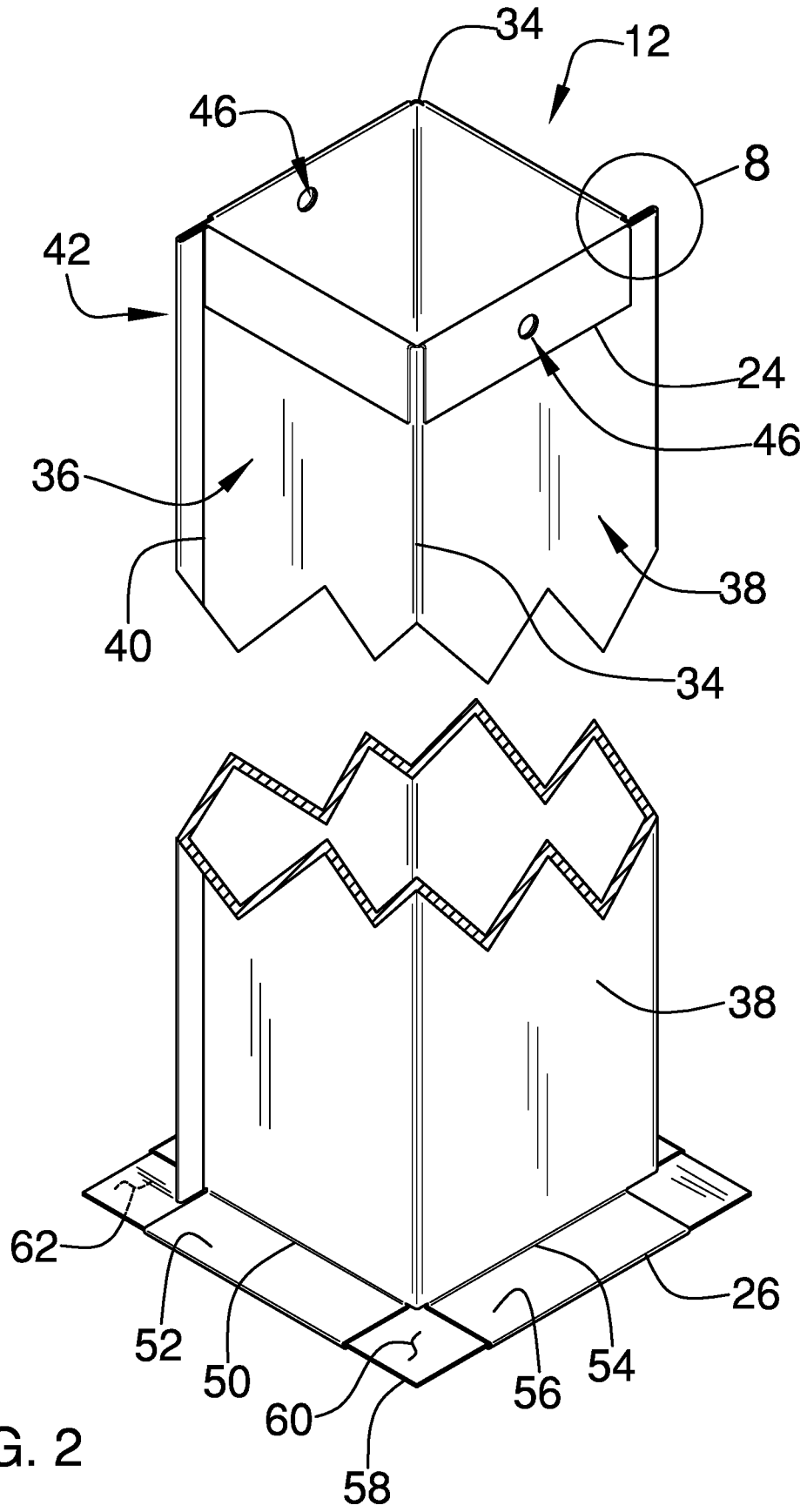
FIG. 2 is a cut-away perspective view of an embodiment of the disclosure.
Figure 3:
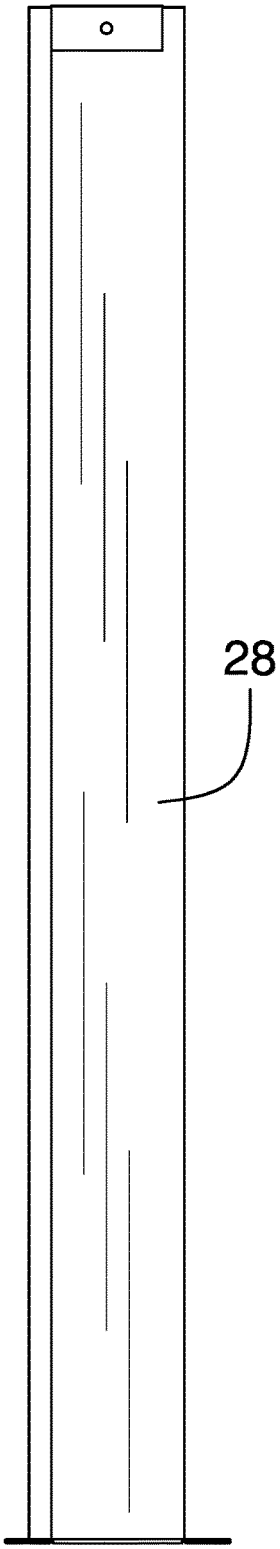
FIG. 3 is a right side view of an embodiment of the disclosure.
Figure 4:
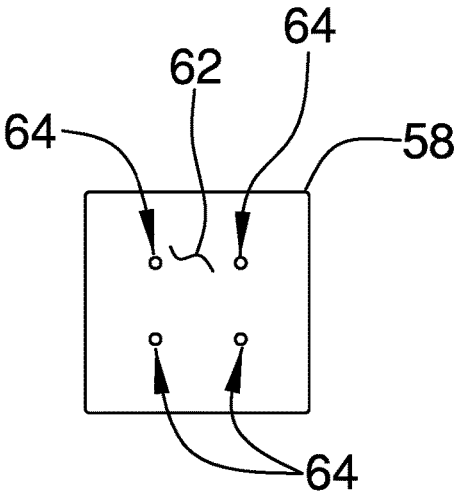
FIG. 4 is a bottom view of an embodiment of the disclosure.

With reference now to the drawings, and in particular to FIGS. 1 through 8 thereof, a new sleeve device embodying the principles and concepts of an embodiment of the disclosure and generally designated by the reference numeral 10 will be described.

As best illustrated in FIGS. 1 through 8, the fence post sleeve assembly 10 generally comprises a post guide 12 which comprises a first half 14 being coupled to a second half 16 such that the post guide 12 defines a sleeve 18 for insertably receiving a fence post 20. The post guide 12 is comprised of a rigid material thereby facilitating the post guide 12 to be buried in a post hole 22 without collapsing. In this way the fence post 20 can be inserted or removed from the post hole 22 without requiring the fence post 20 to be permanently fixed in the post hole 22. Thus, the fence post 20 can be easily replaced in the event that the fence post 20 is damaged.

Each of the first half 14 and the second half 16 has an upper end 24, a lower end 26 and an outer wall 28 extending between the upper end 24 and the lower end 26. Each of the first half 14 and the second half 16 is elongated between the upper end 24 and the lower end 26. Additionally, the outer wall 28 of each of the first half 14 and the second half 16 has a first lateral edge 30 and a second lateral edge 32. The outer wall 28 of each of the first half 14 and the second half 16 has a first bend 34 extending between the upper end 24 and the lower end 26 to define a first portion 36 forming an angle with a second portion 38, and the first bend 34 is centrally positioned between the first lateral edge 30 and the second lateral edge 32. The outer wall 28 corresponding to the first portion 36 has a second bend 40 extending between the upper end 24 and the lower end 26 to define a lip portion 42 of the outer wall 28, and the second bend 40 is spaced from the first lateral edge 30. Moreover, the lip portion 42 is folded over onto itself having the first lateral edge 30 being aligned with the second bend 40 to define a channel 44 in the lip portion 42 which extends between the upper end 24 and the lower end 26.

The channel 44 in the lip portion 42 associated with the first half 14 insertably receives the second lateral edge 32 of the second half 16. Additionally, the channel 44 in the lip portion 42 associated with the second half 16 insertably receives the second lateral edge 32 of the first half 14. In this way the sleeve 18 defined by each of the first half 14 and the second half 16 has a rectangular shape. The outer wall 28 of the first portion 36 of each of the first half 14 and the second half 16 is folded over onto itself along a line positioned adjacent to the upper end 24 such that the upper end 24 associated with the first half 14 is directed downwardly along the outer wall 28. Additionally, the outer wall 28 of the second portion 38 of each of the first half 14 and the second half 16 is folded over onto itself along a line positioned adjacent to the upper end 24 such that the upper end 24 associated with the second half 16 is directed downwardly along the outer wall 28.

The outer wall 28 associated with the second portion 38 of each of the first half 14 and the second half 16 has a hole 46 extending through the outer wall 28. The hole 46 can receive a fastener 48 to engage the fence post 20 for retaining the fence post 20 in the sleeve 18 defined by the first half 14 and the second half 16. Additionally, the hole 46 is positioned adjacent to the upper end 24. The fastener 48 may be a screw or other type of penetrating fastener which can engage the fence post 20.

The outer wall 28 of the first portion 36 of each of the first half 14 and the second half 16 has a third bend 50 that is positioned adjacent to the lower end 26 to define a first flange 52. The outer wall 28 of the second portion 38 of each of the first half 14 and the second half 16 has a fourth bend 54 that is positioned adjacent to the lower end 26 to define a second flange 56. A base 58 is attached to the post guide 12 to inhibit the fence post 20 from passing through the sleeve 18 defined by the first half 14 and the second half 16. The base 58 has an upper surface 60 and a lower surface 62, and each of the first flange 52 and the second flange 56 lies on the upper surface 60 of the base 58. Furthermore, each of the first flange 52 and the second flange 56 is bonded to the upper surface 60. The base 58 has a plurality of holes 64 each extending through the upper surface 60 and the lower surface 62.

Figure 5:
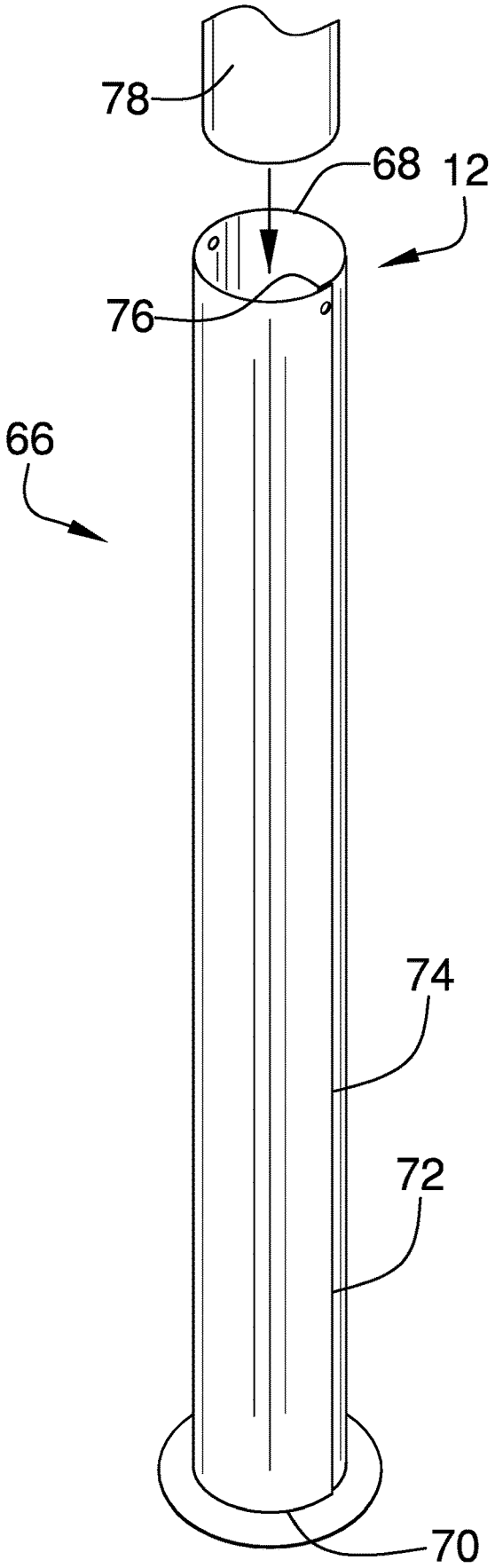
FIG. 5 is a perspective view of an alternative embodiment of the disclosure.
Figure 6:
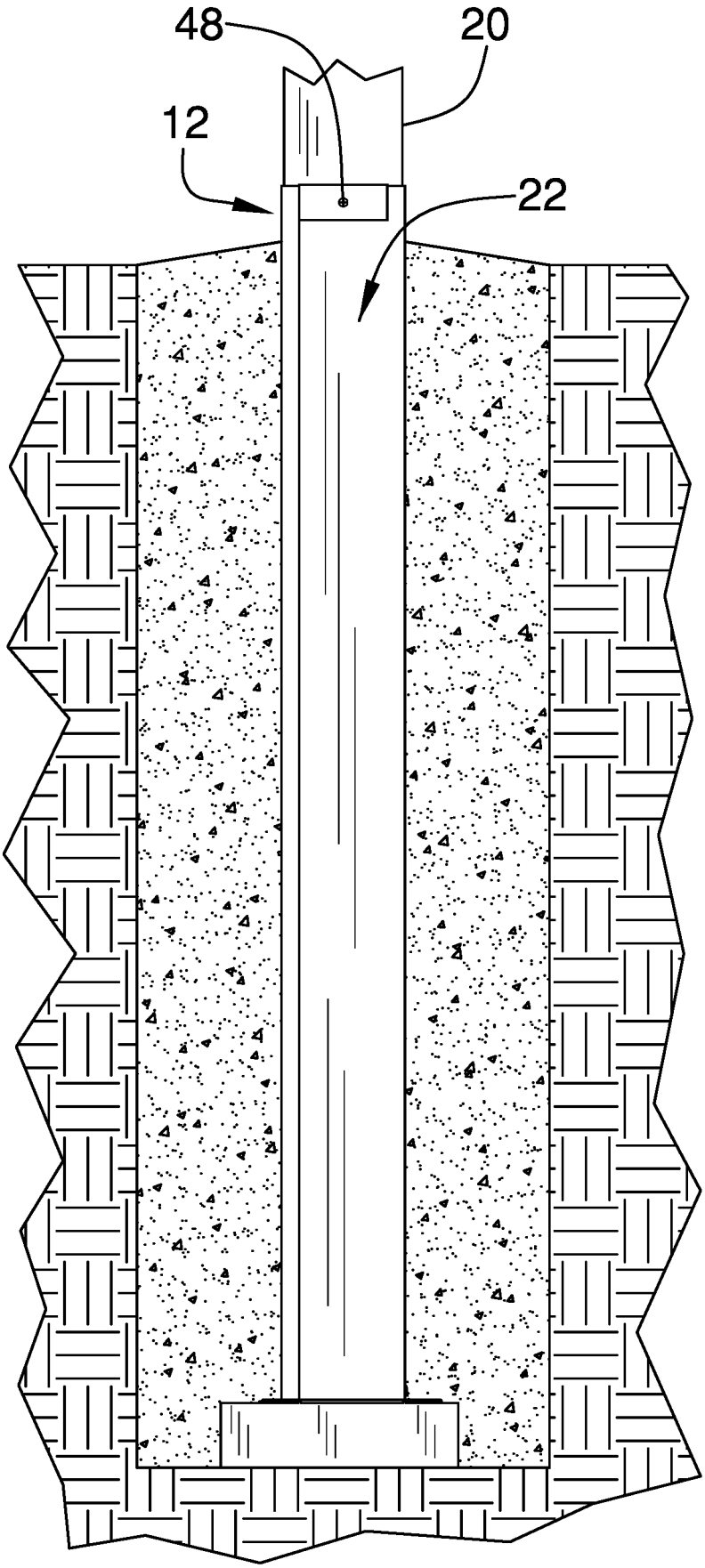
FIG. 6 is a below ground in-use view of an embodiment of the disclosure.
Figure 7:
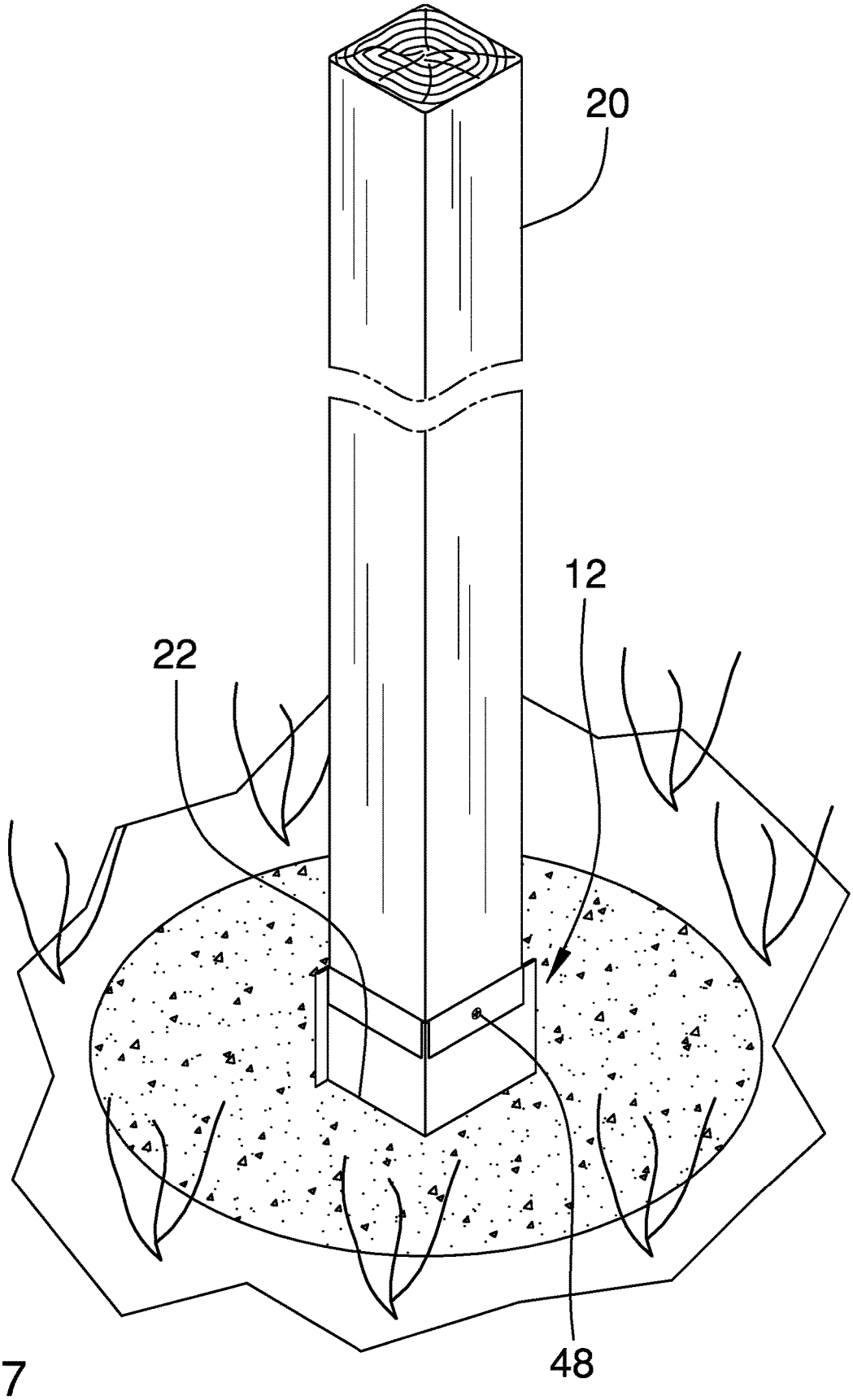
FIG. 7 is a perspective in-use view of an embodiment of the disclosure.
Figure 8:
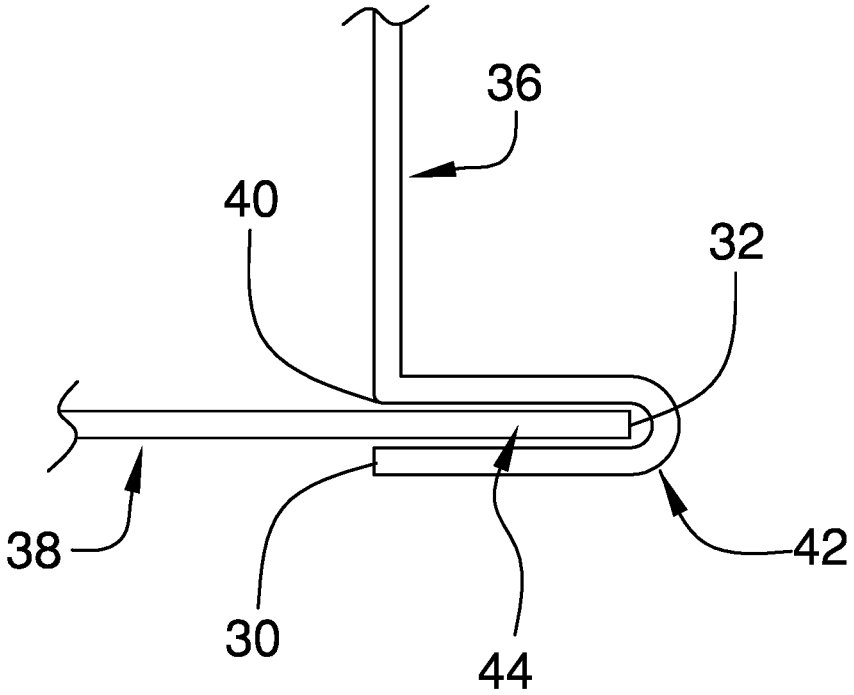
FIG. 8 is a detail view taken from circle 8 of FIG. 2 of an embodiment of the disclosure.

In an alternative embodiment 66 as is most clearly shown in FIG. 5, the post guide 12 has a top end 68, a bottom end 70 and a perimeter edge 72 extending between the top end 68 and the bottom end 70, and the perimeter edge 72 has a first side 74 and a second side 76. The post guide 12 is rolled onto itself such that the first side 74 overlaps the second side 76 thereby facilitating the post guide 12 to define a cylinder to insertably receive a round fence post 78.

In use, a post hole 22 is excavated to a desired depth and a brick 80, or other resilient object, is placed in the bottom 82 of the post hole 22. The post guide 12 is lowered into the post hole 22 such that the base 58 rests on the brick 80 in the bottom 82 of the post hole 22. The post hole 22 is filled with concrete, dirt or other type of fill to surround the post guide 12 and retain the post guide 12 in the post hole 22. Additionally, the post hole 22 is excavated to a depth that facilitates the post guide 12 to extend upwardly out of the post hole 22 a distance of at least 6.0 inches. In this way the fence post 20 can be lowered into the post guide 12 in order to vertically orient the fence post 20 to construct a fence. Furthermore, the fence post 20 can be removed from the post guide 12 at any time to service or replace the fence post 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fence post sleeve assembly for facilitating a fence post to be installed or removed from a post hole, said assembly comprising:

a post guide comprising a first half being coupled to a second half such that said post guide defines a sleeve wherein said sleeve is configured to insertably receive a fence post, said post guide being comprised of a rigid material wherein said post guide is configured to be buried in a post hole without collapsing thereby facilitating the fence post to be inserted or removed from the post hole; and a base being attached to said post guide wherein said base is configured to inhibit the fence post from passing through said sleeve defined by said first half and said second half;

wherein each of said first half and said second half has an upper end, a lower end and an outer wall extending between said upper end and said lower end, each of said first half and said second half being elongated between said upper end and said lower end, said outer wall of each of said first half and said second half having a first lateral edge and a second lateral edge;

wherein said outer wall of each of said first half and said second half has a first bend extending, between said upper end and said lower end to define a first portion forming an angle with a second portion, said first bend being centrally positioned between said first lateral edge and said second lateral edge;

wherein said outer wall corresponding to said first portion has a second bend extending between said upper end and said lower end to define a lip portion of said outer wall, said second bend being spaced from said first lateral edge, said lip portion being folded over onto itself having said first lateral edge being aligned with said second bend to define a channel in said lip portion extending between said upper end and said lower end;

wherein said outer wall of said first portion of each of said first half and said second half is folded over onto itself along a line positioned adjacent to said upper end such that said upper end associated with said first half is directed downwardly along said outer wall;

wherein said outer wall of said first portion of each of said first half and said second half has a third bend being positioned adjacent to said lower end to define a first flange;

wherein said outer wall of said second portion of each of said first half and said second half having a fourth bend being positioned adjacent to said lower end to define a second flange; and wherein said base has an upper surface and a lower surface, each of said first flange and said second flange defined on each of said first half and said second half lying on said top surface of said base, each of said first flange and said second flange being bonded to said upper surface, said base having a plurality of holes each extending through said upper surface and said lower surface.

2. The assembly according to claim 1, wherein:

said channel in said lip portion associated with said first half insertably receives said second lateral edge of said second half; and said channel in said lip portion associated with said second half insertably receives said second lateral edge of said first half such that said sleeve defined by each of said first half and said second half has a rectangular shape.

3. The assembly according to claim 1, wherein said outer wall of said second portion of each of said first half and said second half is folded over onto itself along a line positioned adjacent to said upper end such that said upper end associated with said second half is directed downwardly along said outer wall.

4. The assembly according to claim 1, wherein said outer wall associated with said second portion of each of said first half and said second half has a hole extending through said outer wall wherein said hole is configured to receive a fastener to engage the fence post for retaining the fence post in said sleeve defined by said first half and said second half, said hole being positioned adjacent to said upper end.

5. A fence post sleeve assembly for facilitating a fence post to be installed or removed from a post hole, said assembly comprising:

a post guide comprising a first half being coupled to a second half such that said post guide defines a sleeve wherein said sleeve is configured to insertably receive a fence post, said post guide being comprised of a rigid material wherein said post guide is configured to be buried in a post hole without collapsing thereby facilitating the fence post to be inserted or removed from the post hole, each of said first half and said second half having an upper end, a lower end and an outer wall extending between said upper end and said lower end, each of said first half and said second half being elongated between said upper end and said lower end, said outer wall of each of said first half and said second half having a first lateral edge and a second lateral edge, said outer wall of each of said first half and said second half having a first bend extending between said upper end and said lower end to define a first portion forming an angle with a second portion, said first bend being centrally positioned between said first lateral edge and said second lateral edge, said outer wall corresponding to said first portion having a second bend extending between said upper end and said lower end to define a lip portion of said outer wall, said second bend being spaced from said first lateral edge, said lip portion being folded over onto itself having said first lateral edge being aligned with said second bend to define a channel in said lip portion extending between said upper end and said lower end, said channel in said lip portion associated with said first half insertably receiving said second lateral edge of said second half, said channel in said lip portion associated with said second half insertably receiving said second lateral edge of said first half such that said sleeve defined by each of said first half and said second half has a rectangular shape, said outer wall of said first portion of each of said first half and said second half being folded over onto itself along a line positioned adjacent to said upper end such that said upper end associated with said first half is directed downwardly along said outer wall, said outer wall of said second portion of each of said first half and said second half being folded over onto itself along a line positioned adjacent to said upper end such that said upper end associated with said second half is directed downwardly along said outer wall, said outer wall associated with said second portion of each of said first half and said second half having a hole extending through said outer wall wherein said hole is configured to receive a fastener to engage the fence post for retaining the fence post in said sleeve defined by said first half and said second half, said hole being positioned adjacent to said upper end, said outer wall of said first portion of each of said first half and said second half having a third bend being positioned adjacent to said lower end to define a first flange, said outer wall of said second portion of each of said first half and said second half having a fourth bend being positioned adjacent to said lower end to define a second flange; and a base being attached to said post guide wherein said base is configured to inhibit the fence post from passing through said sleeve defined by said first half and said second half, said base having an upper surface and a lower surface, each of said first flange and said second flange defined on each of said first half and said second half lying on said top surface of said base, each of said first flange and said second flange being bonded to said upper surface, said base having a plurality of holes each extending through said upper surface and said lower surface.

6. The assembly according to claim 5, wherein said post guide has a top end, a bottom end and a perimeter edge extending between said top end and said bottom end, said perimeter edge having a first side and a second side, said post guide being rolled onto itself such that said first side overlaps said second side thereby facilitating said post guide to define a cylinder wherein said cylinder is configured to insertably receive a round post.

* * * * *